United States Patent [19]

Caldwell

[11] 4,319,531

[45] Mar. 16, 1982

[54] SHELF MOUNTING SYSTEM, PARTS THEREFOR AND METHOD OF MAKING THE SAME

[75] Inventor: Edward N. Caldwell, Knoxville, Tenn.

[73] Assignee: Dalen Products, Inc., Knoxville, Tenn.

[21] Appl. No.: 94,163

[22] Filed: Nov. 14, 1979

[51] Int. Cl.[3] ..... A47F 5/08

[52] U.S. Cl. ..... 108/152; 248/220.3; 248/220.4

[58] Field of Search ..... 211/87, 187, 90; 108/152; 248/220.3, 220.4, 221.1, 221.2

[56] References Cited

U.S. PATENT DOCUMENTS

| | | | |
|---|---|---|---|
| 1,636,364 | 7/1927 | Hoegger . | |
| 2,247,497 | 7/1941 | Howell et al. | 248/220.4 |
| 2,538,958 | 1/1951 | Angenfeld | 211/90 X |
| 2,542,753 | 2/1951 | DeSwart | 248/239 |
| 2,789,783 | 4/1957 | Jones | 248/220 |
| 2,909,352 | 10/1959 | Van Buren | 248/239 |
| 3,094,892 | 6/1963 | Topf . | |
| 3,289,992 | 12/1966 | Brooks | 248/225 |
| 3,333,555 | 8/1967 | Kapnek | 108/152 |
| 3,527,175 | 9/1970 | Kapnek | 108/152 |
| 3,752,088 | 8/1973 | Kapnek | 108/152 |
| 4,103,854 | 8/1978 | Plimi et al. | 248/235 |

*Primary Examiner*—Roy D. Frazier
*Assistant Examiner*—Robert W. Gibson, Jr.
*Attorney, Agent, or Firm*—Candor, Candor & Tassone

[57] ABSTRACT

A shelf mounting system wherein a shelf unit is mounted to one side of a wall covering solely by a plurality of rigid hangers interconnected by interconnecting portions thereof to the shelf unit and having installing portions thereof respectively disposed in a plurality of openings of the wall covering and bearing against the other side of the wall covering. Each hanger comprises a one-piece rod-like member of a generally uniform cross-sectional configuration throughout its length and having its installing portion defining a generally J-shape disposed in its respective opening and engaging against the other side of the wall covering in a load bearing manner. Each opening is generally of the same cross-sectional size as the cross-sectional configuration of its respective hanger.

4 Claims, 28 Drawing Figures

SHELF MOUNTING SYSTEM, PARTS THEREFOR AND METHOD OF MAKING THE SAME

BACKGROUND OF THE INVENTION

1. Field of the Invention

This invention relates to an improved shelf mounting system and to improved parts for such a shelf mounting system or the like as well as to a method of making such a shelf mounting system.

2. Prior Art Statement

It is known to provide a shelf mounting system wherein a shelf unit is mounted to one side of a wall means solely by a plurality of rigid hangers interconnected by interconnecting portions thereof to the shelf unit and having installing portions thereof respectively disposed in a plurality of openings of the wall means and bearing against the other side of the wall means or being received in studs or the like of the wall structure.

For example, see the following seven U.S. patents:

(1) U.S. Pat. No. 1,636,364—Hoegger
(2) U.S. Pat. No. 2,542,753—DeSwart
(3) U.S. Pat. No. 2,909,352—VanBuren,Jr.
(4) U.S. Pat. No. 3,333,555—Kapnek
(5) U.S. Pat. No. 3,527,175—Kapnek
(6) U.S. Pat. No. 3,752,088—Kapnek
(7) U.S. Pat. No. 4,103,854—Pliml et al.

It is also known to provide a generally J-shaped mounting hanger.

For example, see the following U.S. patent:

(8) U.S. Pat. No. 2,789,783—Jones

It is also known to provide peg board mounting hangers.

For example, see the following two U.S. patents:

(9) U.S. Pat. No. 3,094,892—Topf
(10) U.S. Pat. No. 3,289,992—Brooks

SUMMARY OF THE INVENTION

It is one feature of this invention to provide a shelf mounting system wherein it is relatively simple to mount a shelf unit to an outer wall covering of a wall structure so that the shelf unit can withstand considerable weight imposed thereon without requiring exposed bracing means and the like.

In particular, it was found, according to the teachings of this invention, that a unique J-shaped hanger can be provided and can have the installing portion thereof inserted through a relatively small opening formed in the wall covering to permit an object to be mounted to one side of the wall covering solely by the hanger when the object is interconnected to an outwardly projecting interconnecting portion of the hanger.

Such hangers can be utilized to effectively mount a shelf unit to such a wall covering in a simple and effective manner.

In fact, such wall covering can comprise the conventional sheet rock paneling known as "dry wall," normally found in most contemporary homes and buildings in the United States. Nevertheless, such unique hangers of this invention permit such mounting means to be utilized with other types of wall coverings, as desired.

In particular, one embodiment of this invention provides a shelf mounting system wherein a shelf unit is mounted to one side of a wall means solely by a plurality of rigid hangers interconnected by interconnecting portions thereof to the shelf unit and having installing portions thereof respectively disposed in a plurality of openings of the wall means and bearing against the other side of the wall means, each hanger comprising a one-piece rod-like member of a generally uniform cross-sectional configuration throughout its length and having a straight section and a curved section integrally interconnected thereto so as to define a generally J-shape. The straight section of each hanger is disposed in its respective opening in the wall means and projects generally horizontally from one side of the wall means to define the interconnecting portion thereof to support the shelf thereon, the curved section being disposed adjacent the other side of the wall means in spaced relation thereto and having a substantially straight free end portion disposed generally perpendicular to said straight section and engaging against the other side of the wall means in a load bearing manner. Each opening in the wall means is generally of the same cross-sectional size as the cross-sectional configuration of its respective hanger.

Therefore, it can be seen that this invention merely requires a mounting method of forming relatively small openings through the wall covering of a desired wall structure and then inserting the installing portions of the improved hangers of this invention, in a manner hereinafter set forth, through such openings to support a shelf unit or other object on the outwardly projecting interconnecting portions of such hangers so that the shelf unit or object will be mounted to the exposed side of the wall covering.

In certain embodiments of this invention, as hereinafter set forth, the mounting system of this invention has the hangers thereof completely hidden from view by the shelf unit or object mounted thereby so that it appears that the shelf unit or object is mounted to the wall without any brackets or the like whereby the appearance of the mounted shelf unit or object will not be distracted by exposed mounting brackets and the like.

Therefore, it is an object of this invention to provide an improved shelf mounting system or the like having one or more of the novel features of this invention as set forth above or hereinafter shown or described.

Another object of this invention is to provide a method of making such a shelf mounting system or the like, the method of this invention having one or more of the novel features of this invention as set forth above or hereinafter shown or described.

Another object of this invention is to provide improved parts for such a shelf mounting system or the like, each improved part of this invention having one or more of the novel features of this invention as set forth above or hereinafter shown or described.

Other objects, uses, and advantages of this invention are apparent from a reading of this description which proceeds with reference to the accompanying drawings forming a part thereof and wherein:

BRIEF DESCRIPTION OF THE DRAWINGS

FIG. 26 is a view similar to FIG. 1 and illustrates another embodiment of a shelf unit of this invention mounted to a wall covering or the like.

DESCRIPTION OF THE PREFERRED EMBODIMENTS

Figure 1:
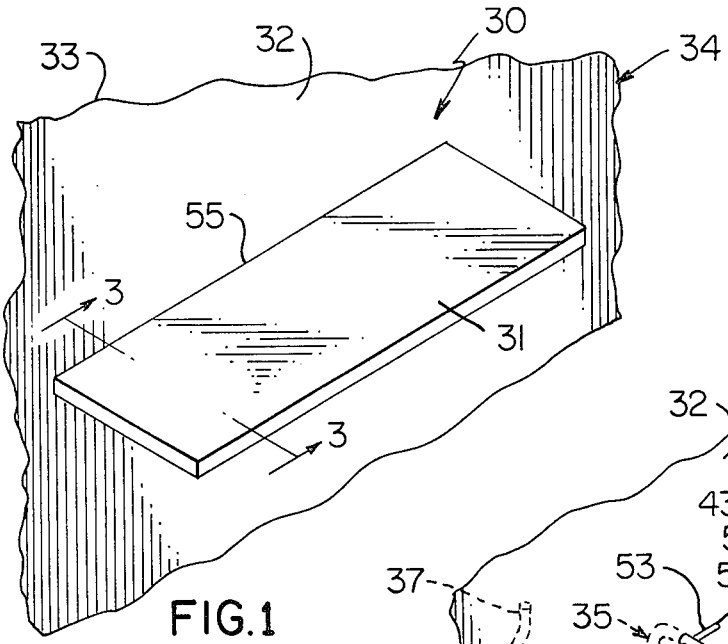
FIG. 1 is a fragmentary perspective view illustrating a shelf member mounted to a wall covering of a wall structure by the method and parts of this invention and thereby providing an improved shelf mounting system of this invention.

While the various features of this invention are hereinafter described and illustrated as being particularly adapted to mount a shelf unit to one side of a wall covering, it is to be understood that the various features of this invention can be utilized singly or in any combination thereof to mount other desired objects to a wall covering or the like, as desired.

Therefore, this invention is not to be limited to only the embodiments illustrated in the drawings, because the drawings are merely utilized to illustrate some of the wide variety of uses of this invention.

Figure 2:
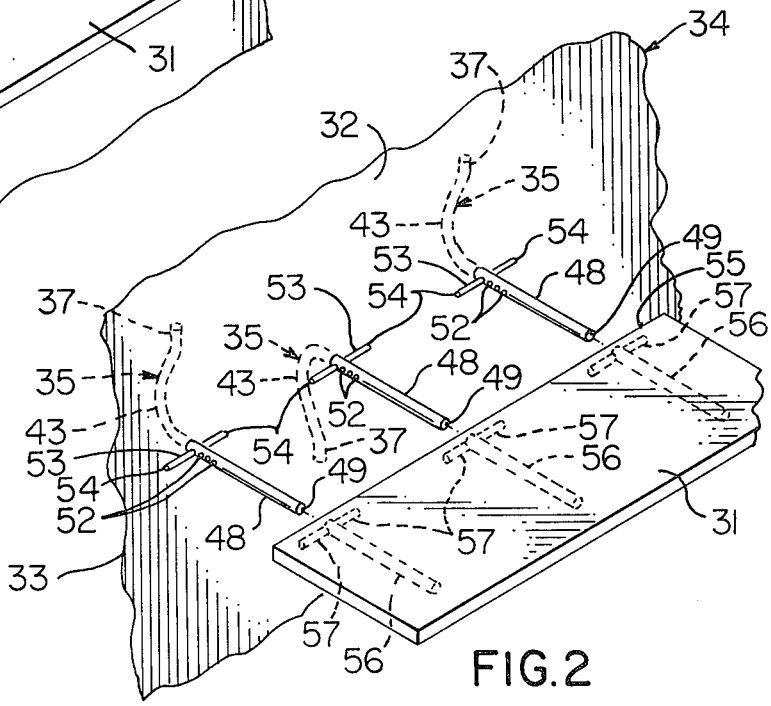
FIG. 2 is an exploded perspective view of the mounted shelf arrangement of FIG. 1.
Figure 3:
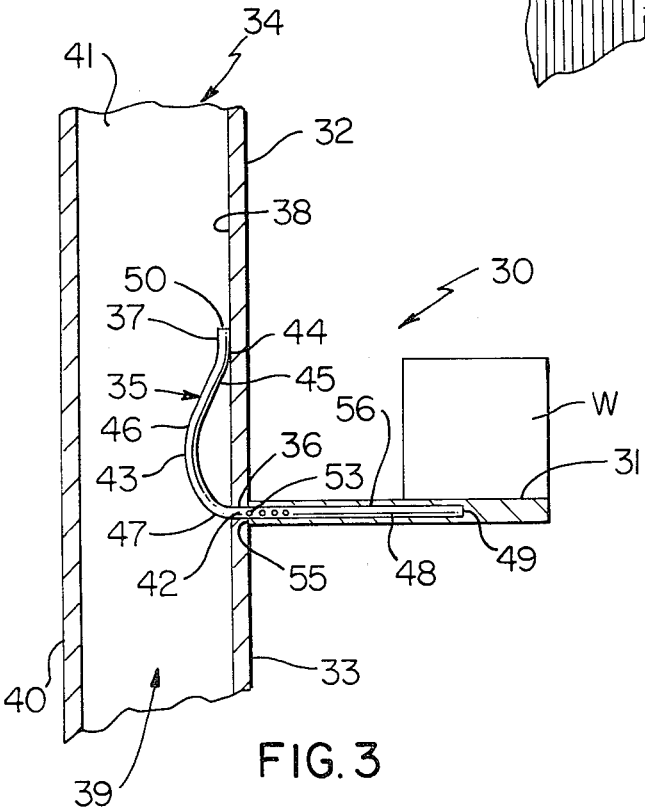
FIG. 3 is an enlarged, fragmentary cross-sectional view taken on line 3—3 of FIG. 1.
Figure 4:
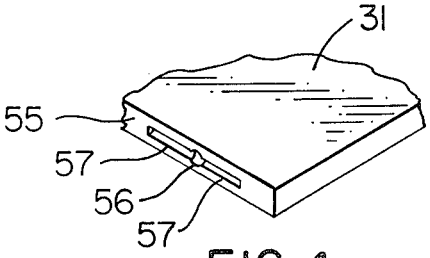
FIG. 4 is an enlarged, fragmentary view of the wall mounting side of the shelf member of FIG. 1.

Referring now to FIGS. 1–3, one embodiment of an improved shelf mounting system of this invention is generally indicated by the reference numeral 30 and comprises a substantially flat shelf member 31 of any suitable material mounted to a side 32 of a wall covering 33 of a wall structure that is generally indicated by the reference numeral 34 in FIG. 3, the shelf member 31 being so mounted by a plurality of rigid hangers 35 of this invention in a manner hereinafter described whereby it can be seen in FIG. 1 that the hangers 35 are completely hidden from view so that the shelf member 31 has the appearance of being a part of the wall structure 34 since there is nothing beneath the shelf 31 to lend support. Thus, the shelf 31 is unique in its appearance and is unincumbered in its function by tranditional brackets or hangers whereby the same has a clean, modern look.

As will be apparent hereinafter, the shelf 31 may be mounted almost anywhere on the wall covering 33 and each shelf 31 to be mounted to the wall 33 is mounted independently of any other shelf 31 thereon so that the shelves 31 can be placed at random to achieve very interesting effects and designs, as desired. And with no brackets on the shelf 31 to interfere with the shelf 31, shelf space on the shelf 31 may be totally used and can be easily cleaned.

Figure 5:
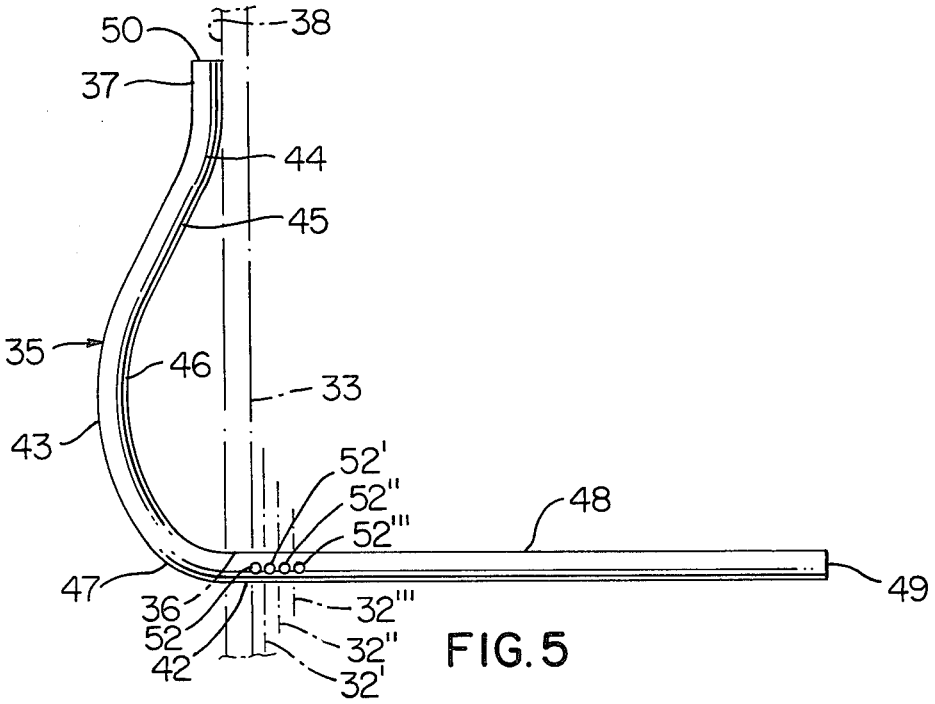
FIG. 5 is an enlarged side view of one embodiment of the improved rigid hanger of this invention.
Figure 6:
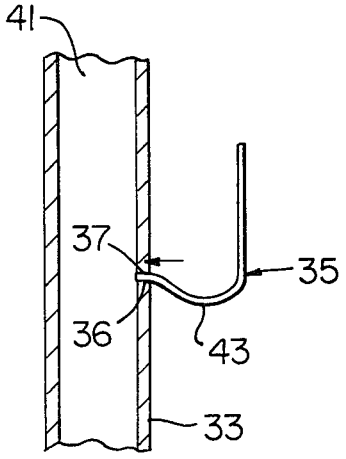
FIGS. 6–10 are respectively fragmentary views similar to FIG. 3 and illustrate the various steps in the method of this invention for inserting the installing portion of the hanger of FIG. 5 of this invention through an opening formed through a wall covering for subsequently supporting an object thereon.
Figure 7:
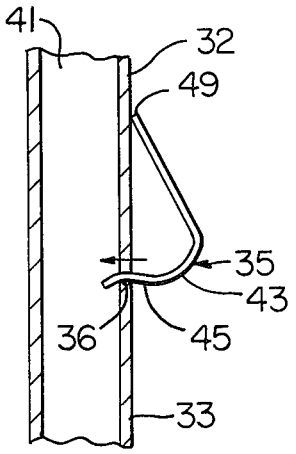

The embodiment of applicant's hanger 35 utilized in the mounting system 30 of FIGS. 1–3 is best illustrated in FIG. 5 wherein it can be seen that the rigid hanger 35 can be formed from steel rod stock of any desired diameter, such as 5/16 of an inch or the like, and be bent by any suitable apparatus into the J-shaped configuration illustrated in FIG. 5 for providing for a maximum reach from a particular opening 36 formed through the wall covering 33 to where a free end portion 37 of the hanger 35 can bear against the inside surface 38 of the wall covering 33 in a load bearing manner so that the moment arm defined by the length of the hanger 35 from the opening 36 to the bearing portion 37 will be the maximum length that can be provided for the conventional spacing 39 formed between the front wall covering 33 and the adjacent wall covering 40 separated therefrom by the conventional $3\frac{1}{2}$ inch wide studs 41 and the like.

As illustrated in FIG. 5, the hanger 35 has a substantially straight portion 42 which will have at least a part thereof disposed in the opening 36 formed in the wall covering 33 with the opening 36 being generally of the same cross-sectional size as the cross-sectional configuration of the hanger 35 of this invention so that only a relatively small hole or opening 36 need be formed through the wall covering 33 by drilling or the like.

The part of the hanger 35 that is adapted to be installed through such small opening 36 in the wall covering 33 comprises the installing portion 43 thereof that has a certain curved configuration to provide for the aforementioned maximum reach of the bearing free end 37 thereof against the inside surface 38 of the wall covering 33 from the opening 36 and such installing portion 43 includes the part of the straight portion 42 which will be disposed in the opening 36 as will be apparent hereinafter. Thus, it can be seen that the installing portion 43 comprises a substantially straight upper free end part 37 interconnected by a bent area 44 to a substantially straight section 45 that is interconnected to a gradually curving section 46 that is interconnected to a sharp curing section 47 that joins to the straight portion 42 thereof.

In the embodiment of the hanger 35 of FIG. 5, the straight portion 42 joins to a continuing straight portion 48 that forms the interconnecting portion of the hanger 35 for interconnecting to the shelf 31 or other object as will be apparent hereinafter.

Thus, it can be seen that the haner 35 of FIG. 5 is generally of a J-shape and when utilized with a wall structure 34 that has a spacing of approximately $3\frac{1}{2}$ inches between the coverings 33 and 40 thereof, the maximum length of the interconnection portion 48 and straight portion 42 thereof is approximately 6 inches and the maximum length of the installing portion 43 thereof that is disposed generally vertical to the straight portion 42 in FIG. 5 is approximately 5 inches.

Figure 8:
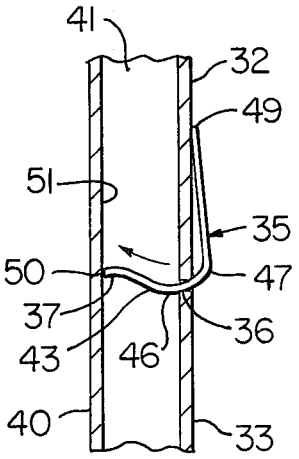
Figure 9:
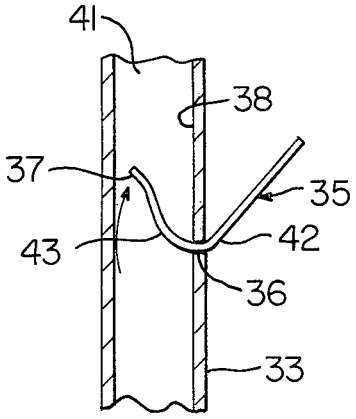

In order to install a hanger 35 of this invention in an opening 36 formed through the wall covering 33, reference is now made to FIGS. 6–10 wherein it can be seen that initially the small opening 36 of a diameter substantially the same as the diameter of the hanger 35 of this invention is formed substantially horizontally through the wall covering 33 in the desired location and remote from the studs 41 thereof. The straight free end 37 of the installing portion 43 of the hanger 35 is then inserted into the opening 36 in the manner illustrated in FIG. 6. Then the straight area 45 of the installing portion 43 of the hanger 35 is passed through the opening 36 in the manner illustrated in FIG. 7 whereby it can be seen that the free end 49 of the hanger 35 is pivoted against the surface or side 32 of the wall covering 33 to permit such straight section 45 to be inserted through the opening 36. Thereafter, with the hanger 35 pivoting with its point 49 against the side 32 of the wall covering 33, the gradual curving section 46 of the hanger 35 is passed through the opening 36 in the manner illustrated in FIG. 8 at which time the end 50 of the free end portion 37 of the installing portion 43 of the hanger 35 clears the inside surface 51 of the other wall covering 40 to permit the sharp curving section 47 of the installing portion 43 of the hanger 35 to now be passed through the opening 36 as illustrated in FIG. 9 to continue the insertion of the hanger 35 into the opening 36 until the straight portion 42 thereof begins to be passed into the opening 36 in the manner illustrated in FIG. 10. At this time, the elongated straight section 37 of the installing portion 43 of the hanger 35 will abut against the inside surface 38 of the wall covering 33 in the manner illustrated in FIG. 10 as the engaging section 37 of the hanger 35 is disposed substantially perpendicular to the straight portion 42 of the hanger 35.

Figure 10:
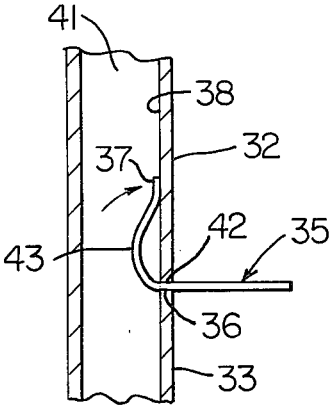

With the hanger 35 now installed in the manner illustrated in FIG. 10, it can be seen that the projecting portion 48 thereof that extends outwardly from the side 32 of the wall covering 33 is substantially horizontal or perpendicular thereto and the opening 36 remains substantially the same size as when the same was initially formed through the wall covering 33.

Since the shelf 31 or other object will be subsequently inserted onto the projecting interconnecting portion 48 of the hanger 35 by being pushed thereon in a manner hereinafter set forth, there would be a tendency to push such straight interconnecting portion 48 into the opening 36 of the wall covering 33 and thereby cause the straight portion 48 to either not remain horizontal or to move the bearing portion 37 away from the inside surface 38 of the wall covering 33.

Therefore, it is a further feature of this invention to provide means in combination with the hanger 35 to bear against the side 32 of the wall covering 33 to prevent such further inward insertion of the free portion 48 thereof into the opening 36 of the wall covering 33 from the position illustrated in FIG. 10 after the same has been installed in the manner illustrated in FIGS. 6–10 and described above.

In particular, in the embodiment of the hanger 35 illustrated in FIG. 5, it can be seen that the installing straight section 42 of the hanger 35 is provided with a plurality of small parallel holes 52 passing transversely therethrough in a spaced manner so as to be disposed substantially perpendicular to the remainder of the installing portion 43 of the hanger 35 for a purpose hereinafter described.

Since the wall coverings 33 are normally no thinner than approximately $\frac{1}{4}$ of an inch and increase in thickness in $\frac{1}{4}$ inch increments, the holes 52 are so formed that the first hole 52 illustrated in FIG. 5 will be just beyond where the front surface 32 of a $\frac{1}{4}$ inch wall covering 33 will be located as represented by the dashed lines 32 in FIG. 5 when the hanger 35 is properly installed in an opening 36 formed therethrough in the manner previously described. Similarly, the next adjacent hole 52' will be disposed just beyond where the front surface 32' of a wall covering 33 of a $\frac{1}{2}$ inch thickness will be located when the hanger 35 is properly inserted therein in the manner illustrated in FIG. 5. Thus, it can be seen that the succeeding holes 52'' and 52''' are arranged for further incremental increases in the thickness of the wall coverings 33 that might be encountered.

Therefore, a cylindrical pin 53 is adapted to be inserted in the particular hole 52 that is disposed closely adjacent the surface 32 of the wall covering 33 when the interconnecting portion 48 of the hanger 35 is disposed substantially horizontally thereto and the bearing portion 37 is disposed against the inside surface 38 of the wall covering 33 in the manner illustrated in FIGS. 3 and 5. This pin 53 has opposed ends 54 which extend outwardly from the opposed sides of the hanger 35 in the manner illustrated in FIG. 2 so the ends 54 will bear against the surface 32 of the wall covering 33 and prevent the interconnecting portion 48 from thereafter being pushed further into the opening 36 during the installing of a desired object on the projected portion 48 of the hanger 35. In addition, the pin 53 will prevent turning or rotation of the hanger 35 within the opening 36 after the desired object has been installed on the hanger 35 as will be apparent hereinafter.

The pin 53 and the holes 52 can each have a diameter of approximately 0.109 of an inch to allow for the spacing between adjacent holes 52 for the aforementioned $\frac{1}{4}$ inch incremental change in thickness of wall covering 33.

Therefore, it can be seen that it is a relatively simple operation to install each hanger 35 of this invention to a wall covering 33 because only a very small opening 36 is formed through the wall covering 33 in any desired location remote from the studs 41 thereof with the hanger 35 being subsequently installed through opening 36 in the manner previously described.

The shelf member 31 of this invention is adapted to be mounted to the interconnection portions 48 of two or more hangers 35 installed in openings 36 in the wall covering 33 in the manner previously described.

In particular, as illustrated in FIG. 2, the shelf member 31 is to be installed on the projecting portions 48 of three hangers 35 arranged in the manner illustrated in FIG. 2 wherein the two end or outboard hangers 35 have the installing portions 43 thereof extending generally vertically upwardly while the middle hanger 35 has its installing portion 43 disposed generally vertically downwardly for a purpose hereinafter described. Thus, it can be seen that the projecting portions 48 of the hangers 35 are disposed in aligned relation and are all substantially horizontal or perpendicular to the side 32 of the wall covering 33.

The shelf member 31 has an end surface 55 that is interrupted by a plurality of holes 56 preformed by drilling or the like into the shelf member 31 a sufficient distance to accept the full length of the respective projecting portions 48 of the hangers 35 received therein and such openings 56 are formed in the end surface 55 in a sufficient number and at certain spacings, as will be apparent hereinafter, so that a desired number of hangers 35 can be utilized in combination therewith to support the shelf member 31 in the manner illustrated in FIG. 1.

The end surface 55 of the shelf member 31 is also provided with a plurality of elongated slots or recesses 57 that are narrower than the openings 56 but are of sufficient size to accept the transverse pins 53 of the hangers 35 therein when the end surface 55 of the shelf member 31 is moved into abutting engagement against the side 32 of the wall covering 33 in the manner illustrated in FIG. 3. Thus, not only are the pins 53 received in the recesses 57 to permit such flush mounting of the end surface 55 of the shelf member 31 against the surface 32 of the wall covering 33, but also the received transverse pins 53 are prevented from rotating relative to the shelf member 31 and thereby prevent the hangers 35 from rotating relative to the shelf member 31 whereby the installed portions 43 thereof will remain in the desired vertical positions as illustrated in FIG. 2. The elongated slots 57 are substantially bisected by the openings 56 to accept the narrow pins 53 for the reasons previously set forth.

Therefore, it can be seen that once the three hangers 35 of FIG. 2 have been installed in their respective openings 36 through the wall covering 33 in the manner previously described, the shelf member 31 can be simply installed onto the projection portions 48 thereof by respectively receiving the interconnecting portions 48 of the hangers 35 in cooperating openings 56 in the end surface 55 of the shelf member 31 with the shelf member 31 being pushed onto those projecting portions 48 until the end surface 55 thereof abuts against the side 32 of the wall covering 33 in the manner illustrated in FIGS. 1 and 3 to complete the installing of the shelf member 31 on the hangers 35 to provide for the shelf arrangement illustrated in FIGS. 1 and 3 in a simple and effective manner.

Accordingly, it can be seen that any subsequent weight placed on the shelf member 31 in the manner provided by the part indicated by the reference letter W in FIG. 3 would tend to provide a downward pivoting action on the two outboard hangers 35 in the holes 36 thereof as determined by a moment arm of generally one-half of the width of the shelf member 31. This downward force on the shelf member 31 is opposed by the length of the moment arm defined by the installed portions 43 of each outboard hanger 35 that is defined by the distance between the openings 36 and the bearing portions 37 of the outboard hangers 35 to maintain the shelf member 31 in the horizontal position even though the shelf member 31 is supporting weight thereon.

For example, a two foot long shelf of approximately eight inches wide was hung on a $\frac{3}{8}$ inch thick sheet rock wall covering using three 5/16 inch steel rod hangers 35 of this invention in an arrangement similar to FIG. 2 and such shelf supported at least 65 pounds without any appearance of sagging of the shelf from the horizontal position thereof.

The middle hanger 35 of FIG. 2 opposes any force being imposed on the shelf member 31 in an upward direction so that the shelf member 31 cannot be pivoted in an upward direction.

Therefore, it can be seen that the shelf member 31 can be mounted to the wall covering 33 in a relatively simple and effective manner as previously described by merely forming three openings 36 through the wall covering 33 by drilling or the like with a drill bit of a diameter substantially the same as the diameter of the installing portions 43 of the hangers 35, openings 36 being located by marking on the wall side 32 marks that correspond to desired holes 56 in the end surface 55 of the shelf member 31. After the openings 36 have been so formed, each hanger 35 has the installing portion 43 thereof inserted through its respective opening 36 in the manner illustrated in FIGS. 6 through 10. Thereafter, the pins 53 are placed in the proper holes 52 of the installed hangers 35 so that the pins 53 will bear against the side 32 of the wall covering 33. Then, the shelf member 31 is pushed onto the projecting portions 48 of the installed hangers 35 by receiving the projection portions 48 in the aligned openings 56 thereof whereby the shelf member 31 can have its end surface 55 moved into abutting relation with the side 32 of the wall covering 33 to receive the transverse pins 53 in the slots 57 thereof to prevent subsequent rotation of the hangers 35 for the reasons previously set forth.

If desired, the hanger 35 of this invention can be formed so that the projecting portion 48 thereof is actually disposed at an angle of approximately 1 degree relative to the horizontal when the installing portion 43 thereof is disposed vertically upwardly. Thus, the end 49 thereof will be above the true horizontal by that one degree angle because it has been found that if a shelf is mounted so that the same is actually extending upwardly at the free end thereof at an angle of approximately 1 degree, the normal inclination is to view such shelf as bending downwardly whereby the actual upward projection thereof is compensated by the normal inclination to assume that the same is projecting downwardly.

In this manner, by having the middle bracket 35 of the shelf system 30 illustrated in FIG. 2 with its projecting portion 49 angled downwardly by the aforementioned one degree while the end or outboard hangers 35 have their projecting portions 48 angled upwardly at the aforementioned 1 degree, such angling causes the projecting portions 48 when subsequently aligned into their respective openings 56 of the shelf member 31 to provide a certain amount of friction fit of the projecting portions 48 in the holes 56 of the shelf member 31 to hold the same in its assembled relation illustrated in FIG. 1 on the projecting portions 48 of the hangers 35.

Of course, the holes 56 in the shelf 31 could be formed of a diameter so that the same will provide a friction or press fit with the projecting portions 48 of the hangers 35 without the aforementioned one degree arrangement of the hangers 35 if desired.

In any event, the ease of installation of the shelf member 31 to the wall covering 33 by the hangers 35 of this invention is such that model shelves have been installed in a matter of approximately 90 seconds from the time of marking the walls for forming the openings 36 of the necessary spacing for the holes 56 in the shelf 31 to the time of actual pushing of the shelf member 31 into place on the installed hangers 35.

Figure 11:
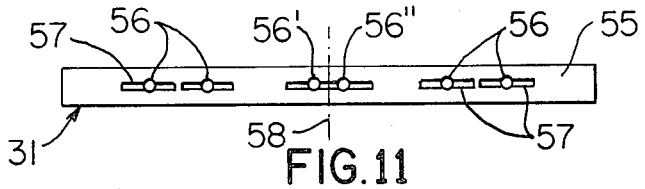
FIGS. 11–13 are respectively end views of the mounting sides of shelf members respectively having different arrangements of openings formed therein for interconnecting to the interconnecting portions of the hangers of this invention.

While the holes 56 can be formed in the end surface 55 of the shelf 31 in any arrangement thereof, one arrangement that has been found satisfactory in order to avoid the studs 41 in a typical wall structure 34, is illustrated in FIG. 11 wherein the holes 56 are formed in pairs at least 2 inches apart symmetrically around the center point of the end surface 55 of the shelf member 31. For example, the center of the end surface 55 of the shelf member 31 is represented by the reference numeral 58 and the two adjacent holes 56' and 56'' are disposed approximately 2 inches apart and 1 inch each from the point 58.

In this manner, if the initial opening 36 formed in the wall covering 33 hits a stud 41, when one was planning to form the opening 36 to correspond to the hole 56' in the shelf 31, then that person merely moves over a sufficient distance to drill a hole 36 which will correspond to the hole 56'' in the shelf member 31 even though the shelf member 31 will still be in exactly the same location on the wall covering 33.

The other holes 56 in the shelf 31 illustrated in FIG. 11 are likewise arranged symmetrical around the center line or point 58.

For example, if the shelf member 31 of FIG. 11 is approximately 36 inches in orveall length, the two outboard holes 56 thereof could be approximately 24 inches apart so as to be at least 2 inches from the adjacent end edge of the shelf member 31 and the next inboard pair of holes 56 could be approximately 8 inches inwardly from the outermost pair of holes 56 and be approximately 8 inches apart.

Figure 12:
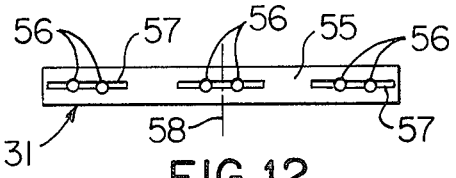

A similar arrangement of holes 56 is provided in the shelf member 31 of FIG. 12 wherein the overall length of the shelf is 24 inches and the outer pair of holes 56 is approximately 20 inches apart and the next inboard pair of holes 56 are approximately 16 inches apart while the middle pair of holes are approximately 2 inches apart and equally spaced from the center line 58 of the shelf member 31.

Figure 13:
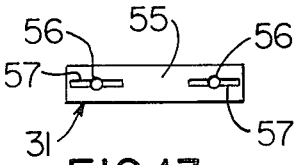

Of course, on a very small shelf member 31 as illustrated in FIG. 13, the holes 56 must be disposed approximately 2 inches inwardly from the ends of the shelf member 31 so that the shelf member 31 can be shifted if a stud 41 is first hit and that particular hole 36 in the wall covering 33 that hit the stud will still be covered by the shelf member 31 when the person shifts the shelf member 31 to avoid that stud 41.

In any event, it can be seen that the end surface 55 of a pairticular shelf member 31 can be provided with an arrangement of holes 56 and slot means 57 so that the normal spacing and width of studding 41 in typical wall structures 34 will not provide a problem so that the holes 36 can be formed in wall coverings 33 to avoid such studding and still permit the shelf member 31 to be arranged thereon in the desired location without worrying about where the studding 41 is located.

While the hanger 35 of this invention has been previously described as having the transverse holes 52 for receiving the bearing pins 53 for the reasons previously set forth, it is to be understood that the hanger 35 of this invention could be provided with other means for bearing against the outside surface of the wall covering for the reasons previously set forth and still be provided with means for adjusting to different wall covering thicknesses.

Figure 14:
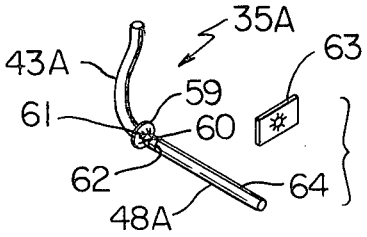
FIG. 14 is an exploded perspective view of another embodiment of the improved hanger of this invention and parts therefor.

For example, reference is now made to FIG. 14 wherein another hanger of this invention is indicated by the reference numeral 35A and parts thereof similar to the hanger 35 are indicated by like reference numerals followed by the reference letter "A".

As illustrated in FIG. 14, the straight or interconnecting portion 48A of the hanger 35A is adapted to receive thereon a push-on type of retainer 59 having an opening 60 formed centrally therethrough and defined by gripping tabs 61 in a manner conventional in the art of push-on lock washers, nuts and the like so that once the hanger 35A has been installed in an opening 36 in a wall covering 33 in the manner previously described, the push-on member 59 can be inserted thereupon until the same engages against the outside surface 32 of the wall covering 33, the projection portion 48A of the hanger 35A having suitable markings 62 thereon corresponding to wall covering thicknesses so that the person will know to which mark the member 59 should be pushed to and still maintain the interconnecting portion 48A in a generally horizontal position. While the push-on device 59 of FIG. 14 is illustrated as being substantially circular, it is understood that the same could be substantially rectangular as represented by the push-on device 63 of FIG. 14 or any desired configuration.

Of course, the particular object to be pushed on the interconnecting portion 48A of the hanger 35A would dictate the shape of the corresponding recess means 57 in the end surface 55 of a shelf member 31 to accept the particular configuration of the push-on device.

In order to insure that the installing portion 43A of the hanger 35A of FIG. 14 would be disposed in a vertical upward position or a vertical downward position, as the case may be, a suitable mark 64 such as a score line, can be provided on the interconnecting portion 48A to correspond to the location of the installing portion 43A thereof.

Figure 15:
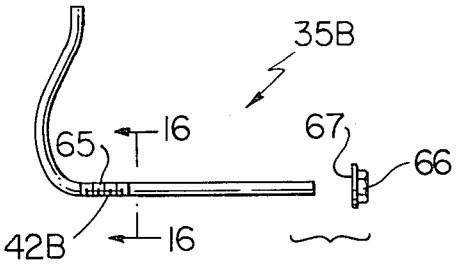
FIG. 15 is a view similar to FIG. 5 and illustrates another embodiment of the rigid hanger of this invention.

Another hanger 35B of this invention is illustrated in FIG. 15 and parts thereof similar to the hanger 35 previously described are indicated by like reference numerals followed by the reference numeral "B".

As illustrated in FIG. 15, the portion 42B of the hanger 35B which will be disposed adjacent the side 32 of the wall covering 33 is externally threaded by threading 65 so that a suitable nut 66, and washer 67 if desired, can be threaded thereon to bear against the side 32 of the wall covering 33 after the hanger 35B has been installed therein in the manner previously described, the threading 65 being provided with suitable marking thereon to indicate wall covering thicknesses if desired.

Figure 16:
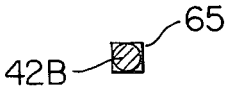
FIG. 16 is a cross-sectional view taken on line 16—16 of FIG. 15.
Figure 17:
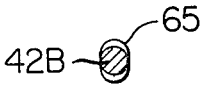
FIG. 17 is a view similar to FIG. 16 and illustrates another embodiment of the hanger of this invention.

If the hanger 35B of FIG. 15 is formed from round stock in the same manner as the hanger 35 previously described, the area 42B thereof can be threaded by first cold forming or the like such area 42B into the square cross-sectional shape illustrated in FIG. 16 or the oblong shape cross-sectional shape as illustrated in FIG. 17 to be subsequently threaded in a manner well known in the art to accept the nut 66 for the reasons previously set forth.

Figure 18:
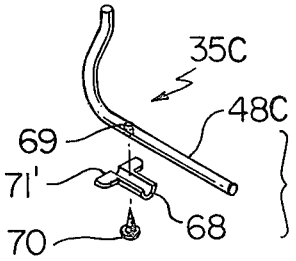
FIG. 18 is a view similar to FIG. 14 and illustrates another embodiment of the rigid hanger of this invention and a part therefor.
Figure 19:
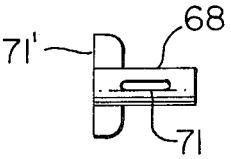
FIG. 19 is a top view of the part for the hanger of FIG. 18.

A hanger 35C of this invention can be provided in the manner illustrated in FIG. 18 wherein an adjustable abutting means 68 of FIG. 19 is utilized therewith, the hanger 35C having the parts thereof that are similar to the hanger 35 indicated by like reference numerals followed by reference letter "C".

As illustrated in FIG. 18, the projecting portion 48C of the hanger 35C can be provided with a threaded hole 69 which is adapted to receive a threaded fastening member 70 that is adapted to pass through an elongated slot 71 formed in the retaining member 68 to fasten the retaining member 68 to the interconnecting portion 48C in any adjusted axial position thereon within the limits of the slot 71 so that an end part 71' of the retainer 68 will abut against the surface 32 of the wall covering 33 in the manner previously described for a similar reason in connection with the transverse pin 53. The slotted part of the retainer 68 that extends from the abutting portion 71' thereof can be curved to mate with the external configuration of the interconnecting portion 48C of the hanger 35C so that the same can be received in the opening 56 of a shelf member 31 or the like and the interconnecting portion 71' thereof will be received in the slot means 57 thereof for the purposes previously set forth.

While the hanger 35 of this invention has been previously described as having the interconnecting portions 48 thereof being received in holes 56 formed in the object to be mounted thereto, it is to be understood that the objects could be mounted on the projecting portions 48 in other manners if desired.

Figure 20:
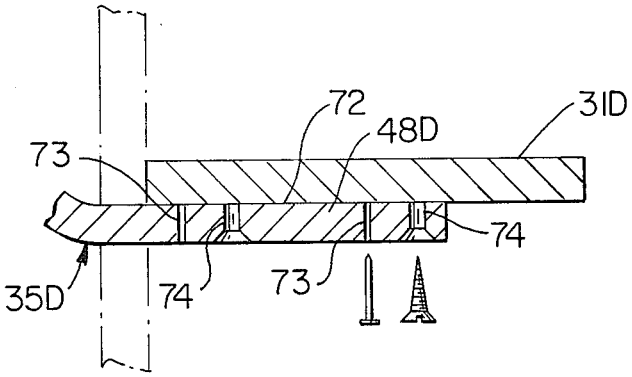
FIG. 20 is a fragmentary view similar to FIG. 3 and illustrates another embodiment of the hanger of this invention.

For example, another hanger 35D of this invention is illustrated in FIG. 20 and parts thereof similar to the hanger 35 previously described are indicated by like reference numerals followed by the reference letter "D".

As illustrated in FIG. 20, the hanger 35D is formed of stock that has a substantially rectangular or square cross-sectional configuration so that the same has a relatively flat upper surface 72 on the projecting portion 48D thereof and on which the shelf member 31D can rest in the manner illustrated in FIG. 20. The shelf 31D can be secured to the projecting portion 48D by having nails hammered therein upwardly through preformed openings 73 in the projecting portion 48D of the hanger 35D or can have screws threaded upwardly therein through preformed openings 74 in the projecting portion 48D of the hanger 35D as illustrated.

It may be found that it is desired to merchandise shelving or the like wherein the hangers 35 of this invention are permanently fastened thereto so that the shelf and interconnecting hangers can be installed as a unit without first installing the hangers 35 as in the system 30 previously described.

For example, such a shelf mounting system is generally indicated by the reference numeral 30E in FIGS. 21–25 and parts thereof similar to the system 30 previously described are indicated by like reference numerals followed by the reference letter "E".

Figure 21:
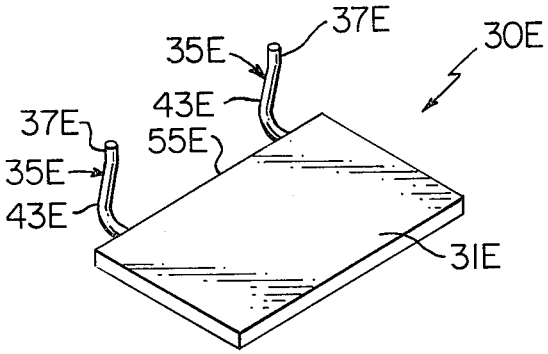
FIG. 21 is a perspective view illustrating another embodiment of this invention wherein a shelf member has a pair of hangers of this invention interconnected thereto.
Figure 22:
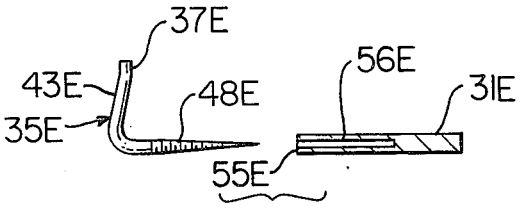
FIG. 22 is an exploded side view of the hanger and shelf member of FIG. 21.
Figure 23:
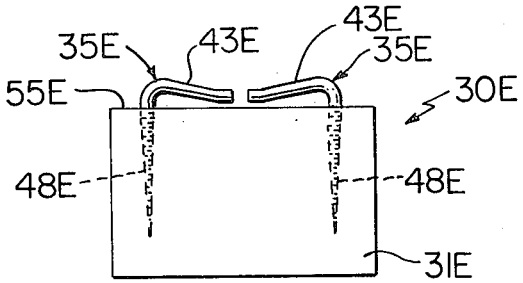
FIG. 23 is a plan view of the shelf arrangement of FIG. 21 with the hangers thereof folded in an out-of-the-way manner for shipping and/or storing purposes.

As illustrated in FIG. 21, a shelf member 31E is provided and has a pair of hangers 35E of this invention interconnected thereto by having the interconnecting portions 48E thereof prethreaded and threaded into openings 56E formed in the end surface 55E of the shelf member 31E in the manner illustrated in FIG. 22 so that the curved or installing sections 43E of the hangers 35E can be rotated and folded over in the manner illustrated in FIG. 23 for storing and shipping purposes. Thereafter, the installing sections 43E can be subsequently unfolded into the installing position illustrated in FIG. 21 to be inserted through openings 36E formed in the wall covering 33E in the manner illustrated in FIG. 25 so that the shelf member 31E will assume the horizontal position illustrated in FIG. 24 when the bearing portions 37E of the hangers 35E bear against the side 38E of the wall covering 33E in the manner illustrated in FIG. 24.

Figure 25:
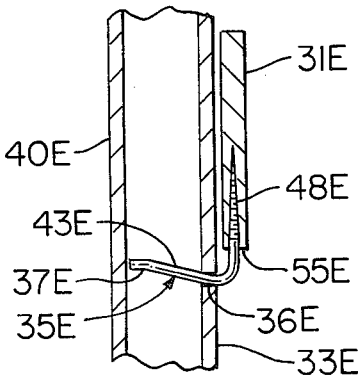
FIG. 25 is a view similar to FIG. 6 and illustrates a step in the method of this invention for mounting the shelf arrangement of FIG. 21 to a wall structure.

Of course, with the shelving member 31E being permanently attached to the hangers 35E, the J-shape of each hanger 35E must be provided with a tighter curve in the installing portion 43E thereof than the more ideal curve of the installing portion 43 of the hanger 35 illustrated in FIG. 5 in order to permit the installing portions 43E of the hangers 35E to be received through the openings 36E in the manner illustrated in FIG. 25 and clear the other proposed wall covering 40E.

Figure 24:
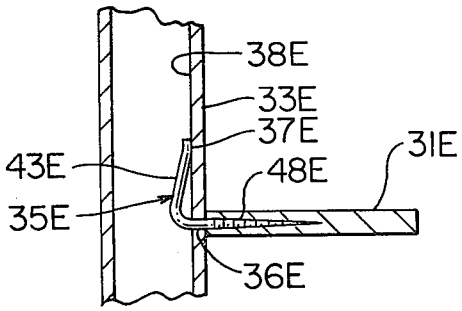
FIG. 24 is a view similar to FIG. 3 and illustrates the shelf arrangement of FIG. 21 mounted to a wall covering.

Nevertheless, it can be seen that the shelf member 31E can be readily installed to a wall covering 33E by merely forming two openings 36E therethrough which correspond in size to cross-sectional thickness of the installing portions 43E of the hangers 35E to permit the installing portions 43E to be inserted therethrough with the shelf 31E attached to the hangers 35E in the manner illustrated in FIGS. 24 and 25.

Of course, in order to compensate for different wall covering thickness, the interconnecting portions 48E of the hangers 35E can be threaded inwardly or outwardly in the holes 56E of the shelf member 31E as the case may be so that the end 55E of the shelf member 31E will abut the side 32E of the wall covering 33E with shelf member 31E being horizontal and the bearing portions 37E of the hangers 35E abutting the inside surface 38E of the wall covering 33E as illustrated in FIG. 24.

While the various arrangements of this invention have been previously described as having the shelf mounted to the wall structure without any brackets therefor, it may be desired to provide brackets for such shelf to make the same more conventional in appearance.

Figure 26:
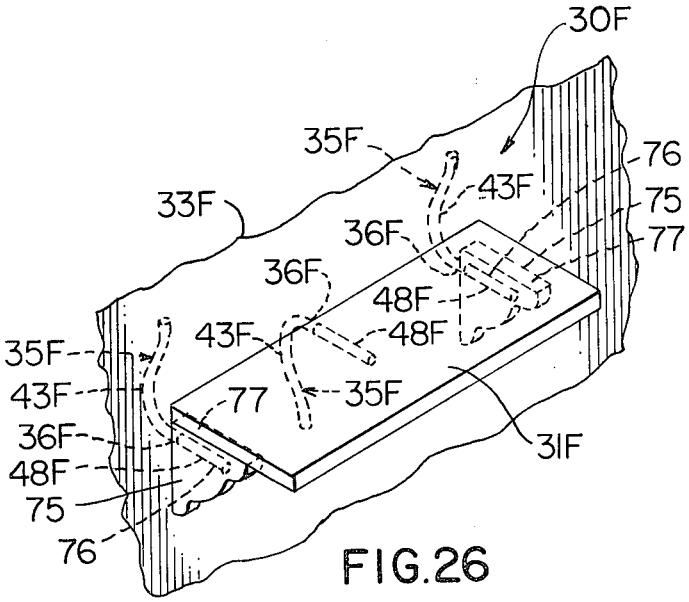

Accordingly, such a conventional shelf mounting system is generally indicated by the reference numeral 30F in FIG. 26 and parts thereof similar to the system 30 previously described are indicated by like reference numerals followed by the reference letter "F".

As illustrated in FIG. 26, the shelf mounting system 30F includes a shelf member 31F and two brackets 75 which are formed of any suitable material and are respectively secured to the wall covering 33F by a pair of hangers 35F each having the interconnecting portion 48F thereof either threaded into or press-fitted into suitable hole means 76 formed in the bracket 75 and having its installing portion 43F disposed substantially vertically upwardly after the same has been installed through the respective opening 36F in the wall covering 33F in the same manner as previously described.

The shelf member 31F has a single bracket 35F interconnected thereto and the same is so arranged that the installing portion 43F thereof is disposed vertically downwardly as illustrated in FIG. 26 to spring load the shelf 31F downwardly to hold the same onto the top supporting surfaces 77 of the bracket members 75.

The holes 76 in the bracket members 75 are located very close to the top surfaces 77 thereof so that should a particular bracket 75 tend to rotate along the wall covering 33F on its hanger 35F, one of the corners thereof would raise significantly and the downwardly biased shelf member 31F would tend to stabilize such bracket 75 to prevent the same from rotating and hold it in firm contact with the shelf member 31F. Thus, by the middle hanger 35F having a one degree downward bias on the interconnecting portions 48F thereof in the manner previously described spring loads on the shelf member 31F down on the surfaces 77 of the bracket members 75 to hold the bracket members 75 perpendicular to the shelf member 31F. The center hanger 35F also holds the shelf member 31F to the wall by friction of its interconnecting portion 48F in the hole 56F of the shelf member 31F and locates it from side to side by its engagement to the shelf member 31F.

In this manner, it can be seen that by forming the opening or hole 76 in a respective bracket 75 so that its particular hanger 35F must have the interconnecting portion 48F thereof screwed into the same or press-fitted into the same, such arrangement provides for adjustment of the hanger 35F relative to the bracket 75 for different wall covering thicknesses, such as is provided by the threaded arrangement in the shelf system 30E previously described. Of course, the bracket 75 could be provided with a recess member adjacent the hole 76 to receive a pin 53 or other retainer for the hanger 35F if desired in the manner provided by the recesses 57.

While the various hangers 35 of this invention have been previously described as interconnecting a shelf part to a wall covering, it is to be understood that the rigid hanger 35 of this invention can be utilized for other purposes as desired.

Figure 27:
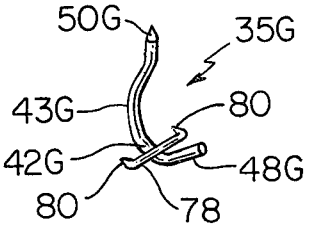
FIG. 27 is a perspective view of another embodiment of the rigid hanger of this invention useable for hanging a picture or the like to one side of a wall covering.
Figure 28:
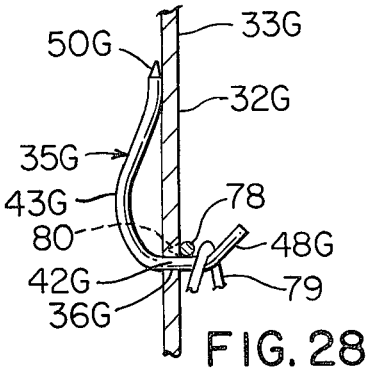
FIG. 28 is a view similar to FIG. 3 and illustrates the hanger of FIG. 27 mounted to a wall covering.

In particular, another rigid hanger of this invention is indicated by the reference numeral 35G in FIGS. 27 and 28 and parts thereof similar to the hanger 35 previously described are indicated by like reference numerals followed by the reference letter "G".

As illustrated in FIG. 27, the hanger 35G has a pointed end 50G for forcing the same through the wall covering 33G illustrated in FIG. 8 to form its own opening 36G and the same has a cross member 78 welded or otherwise secured to the straight portion 42G thereof will the projecting portion 48G is angled relative to the straight section 42G in the manner illustrated in FIG. 28 so that a picture wire 79 or other means can be hung thereon to hang a picture to the side 32G of the wall covering 33G as desired.

The cross member 78 is adapted to bear against the side 32G of the wall covering 33G to prevent further insertion of the hanger 35G through the opening 36G for the reasons previously set forth and the cross member 78 can be provided with turned pointed ends 80 which are adapted to respectively dig into the surface 32G of the wall covering 33G in the manner illustrated in FIG. 28 once the installing portion 43G of the hanger 35G has been inserted into the opening 36G to thereby hold the installed portion 43G substantially vertically upwardly in the manner illustrated in FIG. 28.

Thus, it can be seen that it is relatively simple to utilize the rigid hanger 35G of this invention in the place of picture hooks and the like as the same can form its own opening 36E through the wall covering 33G and have the installing portion 43G thereof perform the load bearing function in the same manner as the J-shaped hangers 35 previously described.

Therefore, it can be seen that this invention not only provides an improved shelf mounting system and the like as well as improved parts for such a system of the like, but also this invention provides an improved method of making such a shelf mounting system or the like.

Further, while various shelves 31 and brackets 75 previously described are indicated as being mounted to the wall coverings 33 by the hangers 35 of this invention in the manners previously described, it is to be understood that while the shelf members 31 and brackets 75 can be provided with the holes and recesses therein, the shelf members 31 and brackets 75 can be utilized in a conventional manner to form conventional shelving arrangements without utilizing the hangers 35 of this invention as such holes and recesses therein will be hidden by the wall against which the same are arranged so that the shelving parts of this invention can be utilized with other installing devices, if desired.

Also, it is to be understood that in all of the shelf systems of this invention previously described, just the hangers of this invention can be merchandised with suitable instructions so that the purchaser thereof will provide the desired shelf or object from another source and use the hangers of this invention to mount the shelf or object in the manner previously described.

While the forms and methods of this invention now preferred have been illustrated and described as required by the Patent Statute, it is to be understood that other forms and method steps can be utilized and still fall within the scope of the appended claims.

What is claimed is:

1. In a mounting system wherein an object is mounted to one side of a wall means by at least one rigid hanger interconnected by one portion thereof to said object and having an installing portion thereof disposed in an opening of said wall means and bearing against the other side of said wall means, the improvement wherein said hanger comprises a one-piece rod-like member of a generally uniform cross-sectional configuration throughout its length and having a straight section and a curved section integrally interconnected thereto so as to define a generally J-shape, said straight section thereof being disposed in said opening and projecting generally horizontally from said one side of said wall means to define said one portion thereof and support at least part of said object thereon, said curved section being disposed adjacent said other side of said wall means in spaced relation thereto, said curved section having a substantially straight free end portion thereof disposed generally perpendicular to said straight section and engaging aginst said other side of said wall means in a load bearing manner, said installing portion of said hanger thereby comprising said curved section and the part of said straight section that is disposed in said opening, said opening being generally of the same cross-sectional size and said cross-sectional configuration of said hanger, said object comprising a shelf that is disposed generally transverse to said one side of said wall means and generally horizontal, said one portion of said hanger being threaded, said object having an opening therein, said one portion of said hanger being threaded into said opening of said object to interconnect said object and said hanger together.

2. A rigid hanger having a portion for installing through an opening formed through a wall means that has opposed sides and another portion for interconnecting to an object, said hanger comprising a one-piece rod-like member of a generally uniform cross-sectional configuration throughout its length and having a straight section and a curved section integrally interconnected thereto so as to define a generally J-shape whereby said straight section thereof is adapted to be disposed in said opening and project generally horizontally from one of said sides of said wall means to define said other portion thereof and support at least part of an object thereon while said curved section is disposed adjacent the other of said sides of said wall means in spaced relation thereto, said curved section having a substantially straight free end portion thereof disposed generally perpendicular to said straight section to engage against said other side of said wall means in a load bearing manner, said installing portion comprising said curved section and part of said straight section that is adapted to be disposed in said opening that has generally the same cross-sectional size as said cross-sectional configuration, said one portion of said hanger being threaded to be threaded in an opening in said object to interconnect said object to said hanger.

3. A hanger as set forth in claim 2 wherein said one portion has a mark thereon for guiding the amount of threading of said one portion into said opening of said hanger.

4. An object to be mounted to one side of a wall means and having at least one rigid hanger interconnected thereto that is provided with a portion for installing through an opening formed through said wall means that has opposed sides and another portion interconnected to said object, said hanger comprising a one-piece rod-like member of a generally uniform cross-sectional configuration throughout its length and having a straight section and a curved section integrally interconnected thereto so as to define a generally J-shape whereby said straight section thereof is adapted to be disposed in said opening and project generally horizontally from said one of said sides of said wall means to define said other portion thereof and support at least part of said object thereon while said curved section is disposed adjacent the other of said sides of said wall means in spaced relation thereto, said curved section having a substantially straight free end portion thereof disposed generally perpendicular to said straight section to engage against said other side of said wall means in a load bearing manner, said installing portion comprising said curved section and part of said straight section that is adapted to be disposed in said opening that has generally the same cross-sectional size as said cross-sectional configuration, said object having a hole therein, said hanger having said other portion thereof received in said hole to interconnect said hanger thereto, said other portion of said hanger being threaded and being thereby threaded into said hole of said object.

* * * * *